US007503564B2

(12) United States Patent
Weigl

(10) Patent No.: US 7,503,564 B2
(45) Date of Patent: Mar. 17, 2009

(54) MULTI-FUNCTION PLAYING ELEMENT AND METHOD OF USING IN A CARD OR TILE GAME

(76) Inventor: William Weigl, 1805 Conwood Dr., Troy, OH (US) 45373

( * ) Notice: Subject to any disclaimer, the term of this patent is extended or adjusted under 35 U.S.C. 154(b) by 380 days.

(21) Appl. No.: 11/327,220

(22) Filed: Jan. 9, 2006

(65) Prior Publication Data

US 2007/0158907 A1 Jul. 12, 2007

(51) Int. Cl.
*A63F 1/00* (2006.01)

(52) U.S. Cl. ..... 273/306; 273/292; 273/303

(58) Field of Classification Search ..... 273/292, 273/303–306; 463/12, 13
See application file for complete search history.

(56) References Cited

U.S. PATENT DOCUMENTS

D132,701 S * 6/1942 McManus ..... D21/379
5,711,526 A * 1/1998 Van Hollebeke ..... 273/303
5,863,043 A * 1/1999 Bitner ..... 273/299
6,247,697 B1 * 6/2001 Jewett ..... 273/292
6,905,122 B2 * 6/2005 Weigl et al. ..... 273/292

OTHER PUBLICATIONS

"Carousel Rummy", Scarne's Encyclopedia of Games, John Scarne, Harper & Row Publishers, 1973, pp. 54-62.*

* cited by examiner

*Primary Examiner*—Benjamin H Layno

(57) ABSTRACT

A card game that includes both wild and skip card features has a predetermined number of cards designated for use as dual-function wild/skip cards. At the option of the card holder at his playing turn, such a dual-function card may be selectively used either as a wild card for melding purposes or as a penalty-imposing card to cause an opponent to whom the card is given to be skipped, i.e., to lose his or her next playing turn or to receive some other comparable or additional penalty.

6 Claims, 1 Drawing Sheet

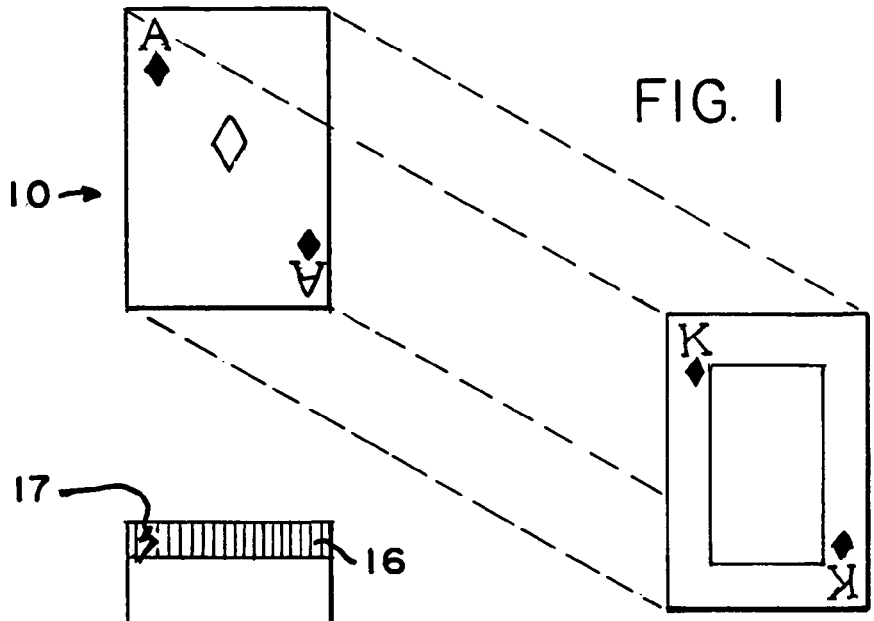
FIG. 1
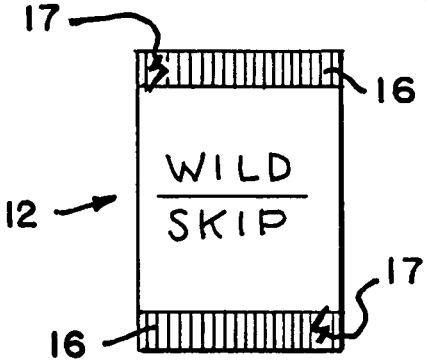
FIG. 2
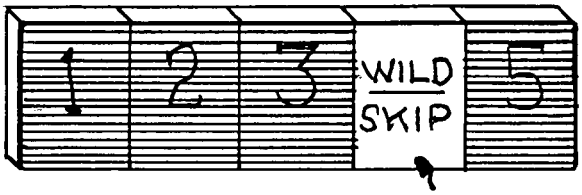
FIG. 4
FIG. 3
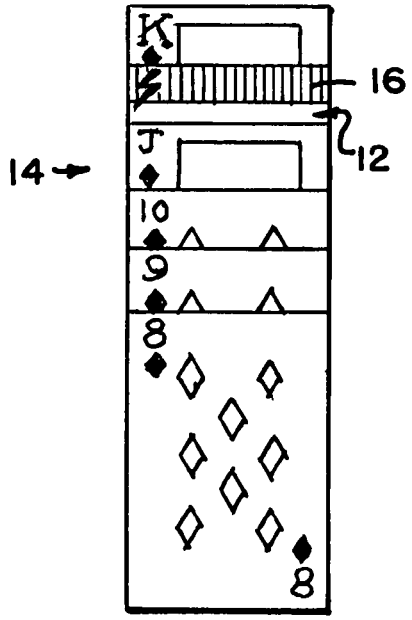
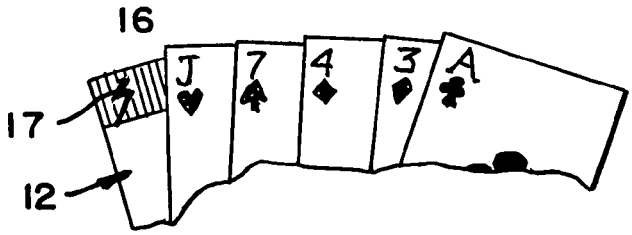
FIG. 5

MULTI-FUNCTION PLAYING ELEMENT AND METHOD OF USING IN A CARD OR TILE GAME

This invention relates to a numeric game apparatus and method of playing, wherein card or tile elements may be melded face up as groups from a player's hand or tile rack onto a playing surface, with a wild element being substitutable for a numeric one in a given group. Specifically, in such a game, a multi-function wild element is designated to be selectively utilized by a player holding or having access to such element to play it either as a conventional "wild" element when melding or as a penalty-imposing element that forces an opponent to take and/or withhold a specific action that is detrimental to the opponent's play. The game fits well into the rummy family of card and tile games as well as others, and its game objective is for a player to seek to "go out" while obstructing opponents from doing so.

BACKGROUND OF THE INVENTION

Numerous card games having distinct suits have been developed over the years, each suit having successive numeric cards, the standard being Ace through King. Wild cards are occasionally employed in a deck of such cards. A typical deck usually has two Jokers that, depending on the game played, may be used as wild cards to substitute for number cards. In the very common game of rummy, for example, a player may meld a "run" of sequential cards such as a 9 of spades, wild card, and Jack of spades, with the wild card substituting for the 10 of spades. Or, the player can meld a "set" of same-numbered cards of different suits, e.g., diamond 4, club 4 and a wild card. These sets and runs are typically melded in groups of three or more cards, with the object of the game being to be the first player to get rid of all cards from hand by melding them, i.e., "going out". In addition, some such games also incorporate what are commonly referred to as Skip cards, that, when played by a player against an opponent, causes that opponent to lose his or her next turn to play.

SUMMARY OF THE INVENTION

A card game that includes both wild and skip card features has a predetermined number of cards designated for use as dual-function wild/skip cards. At the option of the card holder at his playing turn, such a dual-function card may be selectively used either as a wild card for melding purposes or as a penalty-imposing card to cause an opponent to whom the card is given to be skipped, i.e., to lose his or her next playing turn and/or to receive some other additional penalty.

A principal object of the invention is to provide game apparatus and a method of playing a game in which designated elements of the playing deck or group may be selectively used either as wild elements for melding purposes or penalty elements imposed against opponents.

A further object is to provide such a game as will be capable for play as either a card game or a tile game.

Another specific object is to provide for use in a rummy card game of one or more unique multi-function cards that have identifying face indicia or characteristics which enable their easy viewing or recognition when the cards are held either in fanned condition in a player's hand or are melded in shingled fashion on a playing surface.

Yet another object is to ascribe to a primary function card of a deck a secondary penalty-imposing function so as to require exercise of unique and difficult decision-making function selection during play of the game.

Still another object is to provide a rummy game that is capable of providing unique play strategies not previously known in the game of rummy.

Other objects will become apparent from the following description, in which reference is made to the accompanying drawings.

BRIEF DESCRIPTION OF THE DRAWINGS

FIG. 1 is an isometric view of one suit of a deck of standard playing cards.

FIG. 2 is a depiction of one type of dual-function playing card according to the invention.

FIG. 3 shows how cards may be displayed as a run on a playing surface.

FIG. 4 shows how tiles may be displayed as a run on a playing surface.

FIG. 5 depicts a closed hand of various fanned cards being held by a player during play of a game.

DESCRIPTION OF THE PREFERRED EMBODIMENT

Although the concept disclosed and claimed herein may find practical use in several different kinds of card or tile games, it will be simply described in connection with the internationally-accepted game of rummy. Further, while the game can be played equally well with either cards or tiles, the remainder of the description will refer primarily to play with cards for simplicity of description.

Rummy is often described as the best known of all card games played in the United States. Its popularity is largely due to its simplicity and ease of learning. Three-card sets and runs are individually melded on a table as play proceeds in one form of the game or are created and retained in hand during development and are all melded all at the same time when going out in another game form. The term melded as used herein is intended to cover both forms of play, although the game will be primarily described hereinafter with melding that occurs during, rather that at completion of play of a hand.

A set is defined as cards of the same number but of different suits, e.g., number 4's of the suits of spades, hearts, clubs and diamonds. A run is a group of cards of the same suit, but developed in direct sequence, e.g., the 4, 5 and 6 or Jack, Queen and King of clubs. Certain rummy games include the use of wild cards, allowing such wild card to be substituted for any numbered card in a set or run. In such games, particularly where the game involves melding during play onto a playing surface such as a card table, melded cards become accessible to all players for rearranging, adding to, substituting cards, etc. When wild cards are employed in the play, if a wild card is located in a run or set, the actual numbered card which that wild card represents may be substituted for the wild card, and the wild card extracted and used in another set or run to the player's best advantage. But that has been the extent of the use of the wild card to the present time, to the best of my knowledge.

In U.S. Pat. No. 6,905,122 granted on Jun. 14, 2005 to William Weigl et al, a rummy game is described that includes both wild and skipping play features. The skipping feature is also known per se in other card games. It adds the capability of causing a player to lose a turn to play if "skipped" by another who exercises his right to do so by imposing the skip card on an opponent. After completing development of the basic game described in the above '122 patent, I recognized that unusual play strategies become possible if the distinct functions of the wild card and skip card are combined into a single card that can be optionally selected by a player to be used for either function at any time during play of the game. That departs from the previous use of wild cards for one purpose only, and skip cards for a second but completely different purpose. The optional usage potential requires some difficult decision-making strategies, depending on the stage of play of a hand. The dual-function disclosure was added to the above '122 patent application and was claimed in combination with other game features that were the subject of joint inventions with others. The dual function was conceived independently of the combination features of the '122 patent, however, and was added to that patent's disclosure because of a synergistic relationship with the joint invention. The description of the above U.S. Pat. No. 6,905,122 is fully incorporated herein by reference to enable a better and more thorough understanding of this invention.

FIG. 1 is a display of but one of the conventional four suits of a standard card deck, namely the suit 10 of diamonds from Ace through King. It should be noted that other comparable decks, with actual numbers such as 1 through 12 or alphabetical letters and with suits in four different colors will perform equally well. In fact, for educational purposes in school youth math classes for example, numbers help in addition training by utilizing the actual value of each card when scoring against each player as described in the above '122 patent. It is felt that play of the preferred form of rummy game develops cognitive reasoning in much the same way that many psychologists believe that learning and reading of music accomplishes similar brain development.

In the aforementioned '122 patent, two different approaches were disclosed for wild card play and skipping play. In the jointly-developed approach, the wild cards were initially intended solely for melding purposes and the skip cards were solely for the single purpose of causing a skipped player to lose his or her next turn. Also shown in FIG. 6 of the '122 patent is a card that is designated herein as a wild/skip card 12 of FIG. 2. A person holding such a wild/skip card 12 can use it either for melding of sets or runs on a table (see FIG. 3) or can select instead to use it to present it to an opponent who appears about to go out, in order to obstruct that person from doing so. This capability has been found to alert all players to keep track of how their opponents are progressing toward the goal of going out, and to strike or "zap" them at a critical time. But of course, to accomplish that end, a wild/skip card 12 must either be held in hand by the player (see FIG. 5), or the player must be able to gain access to such a card 12 from the table by substituting the actual numbered card that the wild card 12 represents. An example of accessing a wild/skip card 12 from the table is demonstrated in FIG. 3 where a melded vertically-descending diamond run 14 of cards from King through Eight has a wild/skip card 12 in place of the Queen of Diamonds. That card 12 preferably has a colored bar 16 at its top and bottom, in order to stand out visually in the descending run. In addition, it is desirable to place a symbol 17 such as the lightning bolt in the upper left and lower right corners of cards 12. This assists in viewing the card 12 when in a fanned hand held by a player, such as is shown in FIG. 5. It has been found most convenient to meld cards on the table or other playing surface by placing them vertically (as is commonly done with a bridge "dummy hand"), high to low as shown in FIG. 3, and to extend the shingled cards radially outward toward the players from a centrally-located draw pile as in the '122 patent. Thus, during play of the game with a preferred single deck of cards, there being only one Queen of Diamonds in the deck, a person holding that Queen controls access to that wild/skip card 12 in the run 14 for use when desired to accomplish a specific melding or penalty-imposing goal. If the person holding the card notices that an opponent has but a few cards remaining in hand, he can substitute the Queen of Diamonds for the wild/skip card 12 in run 14, hand it to such opponent and cause that opponent to be skipped at his or her next turn. In preferred rules of the game, it is specified that at the time the opponent is skipped, he or she must suffer an additional penalty by making a "blind draw" of one card from the hand of the player who skipped him or her. The blind draw can cause considerable hilarity, since it sometimes happens that taking one card from the hand of the "skipper" may in fact adversely affect the planned future strategy of the skipper. Also, if the skipper held another wild/skip card 12 in his hand at the time of the blind draw, the party skipped might draw it and later exact revenge. This is but one example of how a simple conversion of a wild card to make it also selectively usable as a skip card can drastically change play of the game, making it more strategic by forcing decisions on whether to use a card 12 for one purpose or the other.

In the preferred form of play, once a card 12 has been used for skipping purposes, it is turned face down, out of play for the remainder of that hand. I have found play to be most fun when using six wild/skip cards 12 in a single deck. The game plays well with from two to eight players. When only two or three players are playing, six cards 12 may be considered excessive and two are preferably removed from the deck. When playing with four or more persons, a double standard deck with six cards 12 may also be desired, resulting in considerably different play of the game, particularly in the melding of sets. When using a double deck, since there are two diamond Queens in play, timing of extraction of the card 12 from the run 14 can become critical. Notwithstanding this, I find that six wild/skip cards 12 and a single card deck are preferred for most play.

The game is started with a face-down deal of six cards to each person. With a standard fifty-two card deck and six wild/skip cards 12, play by six persons leaves but twenty-two cards as a draw pile that is placed face down in the center of the table. There is no discard pile in the preferred game, and rules limit melding to a maximum of three cards from a player's hand at each turn. Once a first set or run has been played, subsequent play allows from one to three cards to be melded at each turn. Surprisingly, it is rare, even with a single deck to have a hand result in a "stymie".

FIG. 4 is comparable to FIG. 3 except that it illustrates how tiles can be melded left to right, side-by-side on a table surface. Preferably the tiles are of four different color suits, those of FIG. 4 all being the same color. Here, only tile number 4 of that color suit can be used to extract wild/skip tile 18 and thereafter be utilized either as a wild tile for melding purposes or as a skip tile for penalty purposes. Since tile rummy requires tiles in hand to be held on an inclined tile rack, the blind draw must be done a little differently. The person drawing must point to the tile selected in the draw from the back side of the rack of the skipper, and have it handed over. In order to accomplish this effectively, it is preferable to make the tile racks transparent.

After considerable experimentation, it is felt that the multi-function attributes of the cards 12 and tiles 18 provide an exciting feature not previously experienced in rummy or other games where wild cards are used, notwithstanding its relative simplicity. The term multi-function as used herein is intended to include two or more functions.

As is possible with a large number of such games, it is contemplated that this game or others incorporating the features claimed herein are within the ordinary skill of a computer programmer to develop a game with wild/skip cards for interactive computer-to-computer competition or single individual play over the internet.

Various other changes may be made without departing from the spirit and scope of the claims.

Having described my invention, I claim:

1. In a method of playing a rummy-type game by a plurality of individual players with a deck of cards comprising multiple consecutively-numbered suits and at least two discrete cards, each said card of said deck having opposing sides with a distinct playing face on one side of each and all of said cards having a common appearance back on the sides opposite said faces, said method comprising the steps of:

a) presenting all of said cards in a position of access to all of said players with their back sides facing upwardly;

b) providing a playing surface for melding of three-card sets of identically-numbered cards of different suits and three-card runs of sequentially-numbered and same suit cards within easy accessibility to all of said players;

c) establishing a deal for a hand of play whereby each player is allocated a like predetermined number of cards the faces of which only a receiving player can view;

d) playing individually in succession by melding of cards or drawing cards from the deck if unable to meld at a turn until one player has completely depleted his supply of cards by melding onto said playing surface from those originally dealt and from any received from the deck during play of the hand;

e) melding runs and sets of at least three cards each;

f) designating said at least two discrete cards as multi-function cards having characteristics enabling optional use during play either as wild cards substitutable for numbered cards for melding purposes or as penalty cards for imposing a penalty on an opposing player by placing the penalty card before him; and, g) selectively utilizing said multi-function cards by a player during his playing turn in one of said characteristics during play of the game.

2. The method performed according to the steps of claim 1 wherein, at the time the opposing player receives a penalty card, that opposing player must make a blind draw of at least one card from those remaining cards held by the person who gave him the penalty card at the penalized player's turn.

3. In a method of playing a rummy-type game by a plurality of individual players with discrete elements from a supply comprising multiple suits of consecutively-numbered flat elements and at least two flat multi-function elements distinct from said consecutively-numbered elements, each said consecutively-numbered element having opposing sides with a distinct playing face on one side of each and all of said elements having a common back appearance on the sides opposite said faces, said method comprising the steps of:

a) presenting all of said elements in a position of access to all of said players with their back sides facing upwardly;

b) providing a playing surface for melding of three-element sets of identically-numbered elements of different suits and runs of three-element sequentially-numbered and same suit elements within easy arm reach of all of said players;

c) establishing a deal of a hand of play whereby each player receives a predetermined supply of a number of elements the faces of which only a receiving player can view;

d) playing individually in succession until one player has completely depleted his supply of elements onto said playing surface from those originally received and from any additional elements received from the supply during play of the hand;

e) establishing at least one run on the playing surface with a sequence of at least three elements, one of which three is a multi-function element occupying the normal position of a missing numbered element of the same suit;

f) substituting a numbered element corresponding to said missing numbered element for said multi-function element in said one run and extracting the multi-function element; and g) selectively electing and optionally using said extracted multi-function element either as a wild element in place of a numbered element in melding another run or as a penalty-imposing element requiring an opposing player to whom said element may be given to lose an opportunity to play at his or her next regular turn.

4. The method performed according to the steps of claim 3 wherein all of said elements comprise playing cards, and wherein said method further includes the steps of providing said multi-function cards with features on at least their upper and lower edges to distinguish them visually from the consecutively-numbered cards, and shingling said at least one run vertically when established on said playing surface to make said multi-function card's distinguishing feature stand out prominently from said consecutively-numbered cards.

5. The method performed according to the steps of claim 4 wherein said game is played with a single deck of cards having four distinct suits and at least twelve consecutively-numbered cards in each suit.

6. The method performed according to claim 3 wherein said supply consists of two combined single sets of consecutively-numbered elements.

* * * * *